US006838423B2

(12) United States Patent
Irvin et al.

(10) Patent No.: US 6,838,423 B2
(45) Date of Patent: Jan. 4, 2005

(54) METHOD OF STAIN REMOVAL FROM GARMENTS WORN ON THE BODY

(75) Inventors: Ann Margaret Irvin, Brussels (BE); Katrien Andrea Tony Hellings, Strombeek-Bever (BE); David Roy Sandbach, Overijse (BE); Jean Wevers, Steenhuffel (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/041,170

(22) Filed: Jan. 8, 2002

(65) Prior Publication Data

US 2002/0198126 A1 Dec. 26, 2002

(51) Int. Cl.[7] ..... C11D 14/02; C11D 17/04; C11D 17/00; C11D 3/00; C11D 7/54

(52) U.S. Cl. ..... 510/276; 510/281; 510/293; 510/309

(58) Field of Search ..... 510/281, 283, 510/284, 286, 276, 293, 302, 309, 320, 321

(56) References Cited

U.S. PATENT DOCUMENTS

| | | | | |
|---|---|---|---|---|
| 336,612 | A | | 2/1886 | Wittram |
| 3,369,543 | A | | 2/1968 | Ronce |
| 3,748,268 | A | | 7/1973 | Loudas |
| 3,953,343 | A | | 4/1976 | Barrett, Jr. et al. |
| 3,953,353 | A | * | 4/1976 | Barrett et al. ..... 252/174 |
| 4,273,661 | A | * | 6/1981 | Grey ..... 252/8.8 |
| 4,842,762 | A | | 6/1989 | Sabol, Jr. et al. |
| 4,911,860 | A | | 3/1990 | Van Den Brom |
| 5,122,158 | A | * | 6/1992 | Kuroda et al. ..... 8/137 |
| 5,259,848 | A | | 11/1993 | Terry et al. |
| 5,284,597 | A | | 2/1994 | Rees |
| 5,288,420 | A | | 2/1994 | Mandy |
| 5,324,131 | A | | 6/1994 | Gardner, III |
| 5,370,919 | A | | 12/1994 | Fieuws et al. |
| 5,611,687 | A | | 3/1997 | Wagner |
| 5,662,827 | A | | 9/1997 | Steiger et al. |
| 5,728,669 | A | | 3/1998 | Tyerech |
| 5,731,276 | A | | 3/1998 | Argo et al. |
| 5,765,407 | A | | 6/1998 | Choo et al. |
| 5,872,090 | A | * | 2/1999 | You et al. ..... 510/284 |
| 5,895,504 | A | | 4/1999 | Sramek et al. |
| 6,048,368 | A | | 4/2000 | Tcheou et al. |
| 6,074,705 | A | | 6/2000 | DeBaene |
| 6,283,933 | B1 | | 9/2001 | D'Alessio et al. |
| 6,294,511 | B1 | | 9/2001 | Argo et al. |
| 6,386,781 | B1 | | 5/2002 | Gueret |
| 6,551,000 | B2 | | 4/2003 | Kandasamy et al. |
| 6,644,879 | B2 | | 11/2003 | Irvin et al. |
| 2002/0090251 | A1 | | 7/2002 | Sandbach et al. |
| 2002/0091070 | A1 | | 7/2002 | Englisch et al. |
| 2002/0178511 | A1 | | 12/2002 | Goldoni et al. |
| 2002/0198126 | A1 | | 12/2002 | Irvin et al. |
| 2003/0019046 | A1 | | 1/2003 | Boissie et al. |
| 2003/0035680 | A1 | | 2/2003 | Irvin et al. |

FOREIGN PATENT DOCUMENTS

| | | | |
|---|---|---|---|
| DE | 24 22 191 | | 11/1975 |
| DE | 195 36 714 | | 4/1997 |
| DE | 10 100 209 | A1 | 7/2002 |
| EP | 0 157 653 | | 10/1985 |
| EP | 0 205 999 | | 12/1986 |
| EP | 0 266 200 | | 5/1988 |
| EP | 0 318 470 | | 5/1989 |
| EP | 1 069 178 | A1 | 1/2001 |
| EP | 1 069 180 | A1 | 1/2001 |
| GB | 1 016 053 | | 1/1966 |
| JP | 10099769 | | 4/1998 |
| JP | 2001181683 | A | 7/2001 |
| JP | 2001181958 | A | 7/2001 |
| SE | 7903-310 | | 4/1979 |
| SE | 8406-301 | A | 12/1984 |
| WO | WO 85/00782 | | 2/1985 |
| WO | WO 93/01348 | | 1/1993 |
| WO | WO 95/34630 | | 12/1995 |
| WO | WO 97/20099 | * | 6/1997 |
| WO | WO 99/02769 | | 1/1999 |
| WO | WO 99/57028 | A1 | 11/1999 |
| WO | WO 01/04260 | A1 | 1/2001 |
| WO | WO 02/069363 | A2 | 9/2002 |
| WO | WO 02/079367 | A1 | 10/2002 |
| WO | WO 02/079368 | A1 | 10/2002 |
| WO | WO 02/079369 | A1 | 10/2002 |
| WO | WO 02/079370 | | 10/2002 |

OTHER PUBLICATIONS

Helmac Stain Eraser –Instant Spot Remover (Product Label) Helmac Products Corporation, Alpharetta, GA.

McCrea Bridget–"The Orange Glo Story"–Response Magazine, The Voice of the Electronic Retailing Association –Dec., 2001.

www.folex.net/index. html –"Folex Instant Carpet Spot Remover"–Sep. 10, 2002.

Google Search/Folox Carpet Cleaner –Sep. 10, 2002.

Google Groups/Newsgroups, Jan. 12, 1996 –Tomato Soup Stain Removal from Carpet.

* cited by examiner

*Primary Examiner*—Yogendra N. Gupta
*Assistant Examiner*—John M Petruncio
(74) *Attorney, Agent, or Firm*—Armina E. Matthews; Jeffrey V. Bamber; Brahm J. Corstanje

(57) ABSTRACT

The present invention relates to a method for fabric treatment. More specifically the invention relates to a convenient to carry fabric treatment applicator comprising a heat activatable compound such as a peroxide bleach, which can be advantageously used on clothes while they are worn. Claimed and described is a method for the application of a fabric treatment composition comprising a heat activatable compound such as a peroxide bleach onto a fabric whereby the temperature of the composition is raised with regard to the storage temperature. Further claimed is a fabric treatment applicator comprising a heat activatable compound and a flow interruption means, preferably a valve, to interrupt or allow the flow of the fabric treatment composition.

8 Claims, No Drawings

METHOD OF STAIN REMOVAL FROM GARMENTS WORN ON THE BODY

FIELD OF THE INVENTION

The present invention relates to a method for fabric treatment with an applicator. More specifically the invention relates to a convenient to carry fabric treatment applicator comprising a heat activatable compound, preferably a peroxide bleach, which can be advantageously used on clothes while they are worn. In another aspect the present invention relates to a fabric treatment applicator comprising a heat activatable compound, preferably a bleach, and further comprising a flow interruption means to interrupt or allow the flow of the fabric treatment composition.

BACKGROUND OF THE INVENTION

Portable stain removers for liquid compositions, for pre laundry application, post laundry application or application on fresh stains, are known articles of manufacture. Similarly, portable applicators for the application of other liquid compositions are known, for example in the field of ink removal. Prior art in the former field includes the following documents:

U.S. Pat. No. 5,288,420 discloses a stain removal composition provided in form of a solid stick, which can be applied to selected areas of a fabric in laundry preparations. Various compositions are disclosed comprising surfactants, enzymes and glycols. U.S. Pat. No. 3,748,268 discloses a stain removal composition especially for carpets and upholstery comprising a surfactant for an aerosol formulation. EP 0 205 999 discloses the provision of a laundry preparation composition in the form of a solid stick. WO 85/00782 discloses a kit comprising coloured fluids and an eradicator for these fluids, which can be used on various materials including clothing. DE 2422191 discloses a solution to be used on stains provided in an applicator with a felt insert. DE 19536714 discloses an applicator for a stain removal fluid which takes the form of a pen. WO 99/02769 discloses an impregnated towelette to clean stains from clothes and upholstery, comprising surfactant.

None of the above fabric treatment compositions comprises bleach. Moreover, these patents do not give details concerning on how the various applicators should be used.

Applicators comprising bleach are known in fields other than fabric treatment: U.S. Pat. No. 5,324,131 discloses an applicator for a liquid bleaching agent to be used to eradicate or remove an emphasising ink. The applicator may be provided with a felt tip or roller. U.S. Pat. No. 5,611,687 discloses an oral fluid, e.g. for the teeth or the gum, and an applicator therefore comprising a broad fibre tip or a roller ball.

Prior art documents which address the method of application in some detail include the following documents:

U.S. Pat. No. 5,765,407 describes an on-the-spot stain removal kit, comprising four sponges, and teaches a four step stain removal procedure for satisfactory results.

U.S. Pat. No. 5,122,158 discloses an applicator for an enzyme-containing liquid detergent for the application in laundry preparation. The applicator comprises a porous body made of a synthetic plastic material. The heat resulting from the friction produced by the applicator during application to a fabric is assumed to contribute to a more rapid enzymatic reaction.

Fabric treatment compositions which comprise bleach and surfactant are known from the following documents:

WO 97/20099 discloses an applicator for the post-laundry treatment of fabrics comprising bleach and surfactant. A two step process is taught which involves the use of an iron on one side of the fabric and the use of an absorbent layer on the other side of the fabric. The application of heat and/or pressure by means of an iron is believed to affect the physical characteristics of the stained fabric, such as its viscosity.

U.S. Pat. No. 5,872,090 discloses a stamp like applicator for a fabric treatment composition comprising bleach and surfactant, which is to be applied to a fabric in a rocking motion. The treatment is preferably done on a table top and preferably using an absorbent stain remover situated beneath the fabric and followed by a post treatment process in a hot air clothes dryer/tumble dryer.

The prior art does not disclose a fabric treatment method which is easy to apply on fresh stains, which is suitable for very delicate fabrics, which successfully removes a large variety of stains, namely stains for example from wine, tomato sauce or blood.

It is hence a main objective of the present invention to provide a fabric treatment method, which can be successfully used on a large variety of stains, namely on stains as from wine, tomato sauce or blood.

It is hence a further main objective of the present invention to provide a fabric treatment method, which can be successfully used on a large variety of fabrics, particularly on coloured fabrics and delicate fabrics.

It is a further objective of the present invention to provide a fabric treatment method, which allows single step application.

It is yet a further objective of the present invention to provide a fabric treatment method, which does not leave residues even when no rinsing or other post treatment of the fabric is undertaken.

Moreover, it is an objective of the present invention to provide a mechanically optimised fabric treatment applicator.

In particular, it is an objective to provide a fabric treatment applicator comprising a flow interruption means to interrupt or allow the flow of the fabric treatment composition.

These and other objectives, as apparent from the following description, are addressed by the present invention.

SUMMARY OF THE INVENTION

The present invention relates to a method for fabric treatment. More specifically the invention relates to a convenient to carry fabric treatment applicator comprising a heat activatable compound such as a peroxide bleach, which can be advantageously used on clothes while they are worn. Claimed and described is a method for the application of a fabric treatment composition comprising a heat activatable compound such as a peroxide bleach onto a fabric whereby the temperature of the composition is raised with regard to the storage temperature. Further claimed is a fabric treatment applicator comprising a heat activatable compound and a flow interruption means, preferably a valve, to interrupt or allow the flow of the fabric treatment composition.

DETAILED DESCRIPTION OF THE INVENTION

It has now been found that heat activatable compounds such as bleaches or enzymes are very beneficial for the removal of fresh stains when applied to clothes which are worn on the body. Bleaches are very efficient in removing various stains, such as stains stemming from wine, tomato sauce, blood or grass, which make up a considerable portion of stains found on clothing. On the other hand bleaches who are known to affect the dyes typically utilised in fabric manufacture. Hence the level of bleach in a fabric treatment composition is to be carefully chosen and in view of delicate and colourful fabrics a low level of bleach is preferred. It has now been found that a low level of bleach or another heat activatable compound suffices if the fabric treatment composition is applied when the treated fabric is comprised by clothing worn on the body. Without wishing to be bound by theory it believed that the increase in temperature due to the body of the fabric provides the heat activatable compounds so that satisfactory stain removal is achieved even with low levels of these compounds. It is further believed that the controlled application of such fabric treatment compositions, particularly if comprising bleaches, is critical to avoid fabric damage and to obtain satisfactory stain removal.

Preferred Compositions

Any composition which comprises at least one heat activatable compound and which can be on a fabric is within the scope of the present invention.

It is recognised that chemical reactions are often heat activatable and/or proceed with a higher turnover at elevated temperatures. Hence a heat activatable compound as used herein is to be understood as one which upon application to a fabric delivers a consumer noticeable benefit expressed by a difference of at least one score unit per 20° C. increase in temperature of the fabric treatment composition as defined in the Heat effect test described below. The temperature range for such a test can be any temperature range below body temperature, which is assumed to be about 37° C. Such consumer noticeable benefits may be stain removal, bleaching, softening of fabrics or the like.

Preferred heat activatable compounds are enzymes and bleaches and mixtures thereof. Among bleaches the preferred bleaches are peroxide bleaches, the most preferred being hydrogen peroxide.

Particularly preferred compositions are bleaching compositions and even more preferred compositions are stain removal compositions as described below.

Stain Removal Compositions

One problem associated with known fabric stain removal compositions is their tendency to leave visible residues on fabric surfaces. Such residues are problematic and are preferably to be avoided herein since the present process does not involve conventional immersion or rinse steps. Accordingly, the stain removal compositions herein should, most preferably, be substantially free of various polyacrylate-based emulsifiers, polymeric anti-static agents, inorganic builder salts and other residue-forming materials, except at low levels of 0.1%–0.3%, and preferably 0%, of the final compositions (%, as used herein, denotes % by weight of 100% active). Water used in the compositions should preferably be distilled, deionized or otherwise rendered free of residue-forming materials.

Accordingly, in a preferred aspect of this invention there are provided stain removal compositions which are substantially free of materials which leave visible residues on the treated fabrics. This necessarily means that the preferred stain removal compositions are formulated to contain a high level of volatile materials, and preferably comprise water, preferably at 95%, a cleaning solvent such as BPP at a low, but effective, level, typically 1% to 4%, preferably 2%, hydrogen peroxide at a level from 1% to 3%, preferably 2%, and surfactant at levels of 0.1% to 1%. Advantageously, when thus formulated such compositions exist as phase-stable aqueous solutions rather than as suspensions or emulsions. Thus, such compositions do not require the use of additional emulsifiers, thickening agents, suspending agents, and the like, all of which can contribute to the formation of undesirable visible residues on the fabric.

It is, of course, necessary that the stain removal compositions herein perform their spot-removal function efficiently and effectively. It has now been discovered that use of the applicator in the manner disclosed herein, provides good spot and stain removal performance in particular with the aforesaid high water stain removal composition solutions. Further details of such stain removal compositions are as exemplified hereinafter.

Indeed, as an overall proposition, the chemical compositions which are used to provide the stain removal and the overall cleaning and/or refreshment functions herein comprise ingredients which are safe and effective for their intended use, and, as noted above, do not leave unacceptable amounts of visible residues on the fabrics. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like. In addition, the compositions herein comprise ingredients which are specially selected and formulated to minimize dye removal or migration from the stain site of fugitive, unfixed dyes from the fabrics being cleaned. The preferred compositions herein are formulated to minimize or avoid these problems.

The dye removal attributes of the present compositions can be compared with art-disclosed cleaners using photographic or photometric measurements, or by means of a simple, but effective, visual grading test, the dye removal test described below.

In addition to the foregoing considerations, the compositions used herein are preferably formulated such that they are easily dispensed and are not so viscous or self-adhesive in nature that they render the stain removal applicator unhandy or difficult to use. Preferably the fabric treatment compositions described herein are formulated as liquid fabric treatment compositions. In one alternative they may be provided as a gel. A preferred stain removal composition according to the present invention comprises:

(a) Bleach—The compositions herein comprise from 0% to 99.99%, preferably 0.001% to 7%, by weight, of bleach, preferably peroxide bleach, most preferably hydrogen peroxide. More preferred spot cleaners will comprise 0.5% to 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner.

(b) Solvent—The compositions herein may comprise from 0% to 99.99% preferably from 0% to 10% by weight, of butoxy propoxy propanol (BPP) solvent or other solvents as described herein. Organic solvents are preferred for use in the present compositions. Preferred spot cleaners will comprise 1–4% BPP which is available in commercial quantities as a mixture of isomers in about equal amounts. The isomers, and mixtures thereof, are useful herein. The isomer structures are as follows:

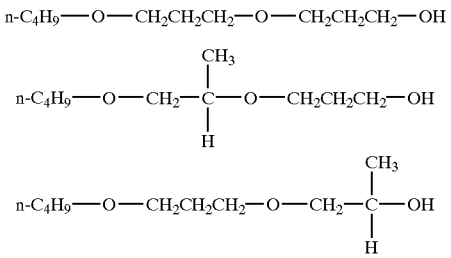

Other useful solvents are hydrotropes such as sodium toluene sulfonate and sodium cumene sulfonate, short-chain alcohols such as ethanol and isopropanol, and the like. They can be present in the compositions as only solvents or in combination with other solvents.

(c) Water—The preferred, low residue compositions herein may comprise from 0% to 99.99%, preferably from 70% to 99.99%, more preferably 90% to 99.9%, most preferably from 94.0% to 99.0%, by weight, of water and hence are preferably aqueous solutions. Water used in the compositions should preferably be distilled, deionized or otherwise rendered free of residue-forming materials.

(d) Surfactant—The compositions herein may optionally comprise from 0% to 99.99%, preferably from 0.05% to 5%, more preferably 0.05% to 2% by weight of surfactants, such as ethoxylated alcohols or alkyl phenols, alkyl sulfates, NaAES, $NH_4$AES, amine oxides, and mixtures thereof. As noted above, use of surfactants limited to the lower end of the range is preferred for some dyes and fabric types. Typically, the weight ratio of BPP solvent:surfactant(s) is in the range of from about 10:1 to about 1:1. One preferred composition comprises 2% BPP/0.8% AES. Also, nonionics such as the ethoxylated $C_{10}$–$C_{16}$ alcohols, e.g., NEODOL 23-6.5, can be used in the compositions. The alkyl sulfate surfactants which may be used herein as cleaners and to stabilize aqueous compositions are the $C_8$–$C_{18}$ primary ("AS"; preferred $C_{10}$–$C_{14}$, sodium salts), as well as branched-chain and random $C_{10}$–$C_{20}$ alkyl sulfates, and $C_{10}$–$C_{18}$ secondary (2,3) alkyl sulfates of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least 7, preferably at least 9, and M is a water-solubilizing cation, especially sodium, as well as unsaturated sulfates such as oleyl sulfate. Alkyl ethoxy sulfate (AES) surfactants used herein are conventionally depicted as having the formula $R(EO)_x$ SO3Z, wherein R is $C_{10}$–$C_{16}$ alkyl, EO is —$CH_2CH_2$—O—, x is 1–10 and can include mixtures which are conventionally reported as averages, e.g., $(EO)_{2.5}$, $(EO)_{6.5}$ and the like, and Z is a cation such as sodium ammonium or magnesium (MgAES). The $C_{12}$–$C_{16}$ alkyl dimethyl amine oxide surfactants can also be used.

(e) Other Optionals—The compositions herein may comprise minor amounts of various optional ingredients, including enzymes, preservatives, anti-static agents, fragrances, odor absorbing components, and the like. If used, such optional ingredients will typically comprise from 0.0001% to 10%, more preferably from 0.01% to 2%, by weight, of the compositions, having due regard for residues on the cleaned fabrics. Preferred optionals are namely the following:

Chelator—The chelating agent is selected from those which, themselves, are stable in aqueous $H_2O_2$ and which stabilize the $H_2O_2$ by chelating vagrant metal ions. Such chelating agents are typically already present at low, peroxide-stabilizing amounts (0.01–1%) in commercial sources of hydrogen peroxide.

Enzymes—Besides the optional nonionic surfactants in the stain removal compositions herein can contain enzymes to further enhance cleaning performance. Lipases, amylases and protease enzymes, or mixtures thereof, can be used. If used, such enzymes will typically comprise from 0.001% to 5%, preferably from 0.01% to 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

It is preferred that a composition according to the present invention comprises either a peroxide bleach or an enzyme.

Preservatives—The compositions herein can optionally be preserved for storage using conventional preservatives such as KATHON® at a level of 0.0001%–1%, by weight.

Anti-static agents—If an antistatic benefit is desired, the compositions used herein can contain an anti-static agent. If used, such anti-static agents will typically comprise at least 0.5%, typically from 2% to 8%, by weight, of the compositions. Preferred anti-stats include the series of sulfonated polymers available as VERSAFLEX 157, 207, 1001, 2004 and 7000, from National Starch and Chemical Company Fragrances—The odor absorbing composition of the present invention can also optionally provide a "scent signal" in the form of a pleasant odor which signals the removal of malodor from fabrics. The scent signal is designed to provide a fleeting perfume scent, and is not designed to be overwhelming or to be used as an odor masking ingredient. When perfume is added as a scent signal, it is added only at very low levels, e.g., from 0% to 0.5%, preferably from 0.003% to 0.3%, more preferably from 0.005% to 0.2%, by weight of the usage composition.

Perfume can also be added as a more intense odor in product and on surfaces. When stronger levels of perfume are preferred, relatively higher levels of perfume can be added. Any type of perfume can be incorporated into the composition of the present invention.

Odor absorbing components—The compositions of the present invention may further comprise an optional cyclodextrin. This will impart the composition with odour absorbing properties, which is especially useful for application on inanimate surfaces to control the malodour.

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The preferred cyclodextrins are available, e.g., from Cerestar USA, Inc. and Wacker Chemicals (USA), Inc.

Typical levels of cyclodextrin in usage compositions for usage conditions are from 0.01% to 5%, preferably from 0.1% to 4%, more preferably from 0.2% to 2% by weight of the composition.

The selected pH range of the stain removal compositions assists in stabilising the hydrogen peroxide and is typically in the acid-slightly basic range from about 3 to about 8, preferably about 6.

EXAMPLES OF STAIN REMOVAL COMPOSITIONS

Having due regard to the foregoing considerations, the following illustrates preferred examples of stain removal compositions, but is not intended to be limiting thereof.

Example 1

| | % (wt) of 100% active component formula range |
|---|---|
| BPP | 1.0–2.0 |
| Hydrogen peroxide | 1.5–3.0 |
| Alkyl sulfate surfactant | 0.3–1.0 |
| Perfume | 0.005–0.01 |
| Ethanol | 0.3–1.0 |
| EDTA | <0.01 |
| Water | Balance |

Example 2

| | % (wt) of 100% active component formula range |
|---|---|
| BPP | 1.0–2.0 |
| Hydrogen peroxide | 1.5–3.0 |
| LIPOLASE | 0.3–0.5 |
| Alkyl sulfate surfactant | 0.3–1.0 |
| Perfume | 0.005–0.01 |
| Ethanol | 0.3–1.0 |
| EDTA | <0.01 |
| Water | Balance |

The effect of heat on the performance of a stain removal composition according to Example 1 has been studied by the Heat effect test as described below.

Bleaching Compositions

Another example of a preferred composition according to the present invention is a bleaching composition.

A preferred bleaching composition comprises hydrogen peroxide, water, and may in addition comprise other components such as fragrance and solvents as described herein above. Preferred levels in % by weight of 100% active component for these components are given in the Example below:

| | % (wt) of 100% active component formula range |
|---|---|
| Hydrogen peroxide | 1.5–3.0 |
| BPP | 1.0–2.0 |
| Perfume | 0.005–0.01 |
| Ethanol | 0.3–1.0 |
| EDTA | <0.01 |
| Water | Balance |

A bleaching composition as disclosed herein may be used for stain removal. A bleaching composition is most effective for stain removal on bleachable stains, e.g. wine, tomato sauce, blood stains.

Preferred Applicators

Generally all convenient to carry applicators are within the scope of the present invention. The choice of a particular applicator will largely depend on the usage envisaged. For example a wipe or a towelette applicator may be chosen. Such wipes or towelettes may be packaged individually or a plurality of them may be packaged together. Preferably such packaging prevents evaporation of the compositions disclosed herein.

Other preferred applicators are those comprising a nib. Such applicators typically also comprise a housing comprising a reservoir for the storage of a composition. Such a housing may be a bottle of any shape or size. Preferred shapes for such housings are hollow barrel shapes, most preferably having a diameter to length ratio from 1:30 to 1:2, so as to be convenient to hold in the user's hand, use and store. More preferred are housings of a diameter to length ratio from 1:20 to 1:5, which resemble in shape a pen, e.g. a ball pen or a highlighter pen, and which are herein referred to as pen-shaped. The reservoir may be filled with an absorbent material, such as a wadding or a cartridge style device such as those commonly found in ink pens able to release liquid on demand. The housing may be made of any solid material, which may also be flexible, such as glass or any plastic material. A preferred material is polypropylene.

The housing may have one or more application devices. An application device, as used herein, is a device which in use is in contact with the surface on which the fabric treatment applicator is used and delivers the fabric treatment composition to that surface. One preferred application device according to the present invention is a nib. Other preferred application devices include any felt, non-woven material, sponge, or foam insert, for example in the form of a porous pad. Another preferred application device is a roller ball. Applicators comprising no other application device but a nib are preferred.

Such a nib typically is a fibre-tip nib as commonly found in children's colouring pens or highlighting pens. Preferably the nib is cone-shaped or wedge-shaped.

A cone or wedge shaped nib allows the exertion of pressure on a relatively narrow area, which is beneficial for mechanical stain removal, without leading to damage of the nib, which is thicker and hence more stable closer to the housing. A cone or wedge shaped nib also allows the application of the fabric treatment composition to a small selected area which is beneficial for low moistening of the fabric and low residues.

The application device should further be in contact with the reservoir directly or indirectly so as to allow transfer of the fabric treatment composition to the application device during use. The nib may be made of any synthetic or man-made or natural materials such as felt, open cell foam, closed cell foams, polyethylene, nylon etc. A preferred material for the nib is felt, even more preferred are synthetic fibres. The nib may have any shape, cone style or 'wedge shape' being preferred for the nib. The nib while held by the housing has a section external to the housing, this section preferably measures from 3.0 cm to 0.1 cm, more preferably from 1.0 cm to 0.25 cm, most preferably from 0.75 cm to 0.5 cm in length.

The contact area—measured as given below—between the nib and a flat surface preferably is from 0.25 $mm^2$ to 400 $mm^2$, more preferably from 1 $mm^2$ to 100 $mm^2$, most preferably from 4 $mm^2$ to 10 $mm^2$. Such a contact area ensures optimal mechanical stain removal and allows for application of the fabric treatment composition to small selected areas.

Particularly preferred applicators according to the present invention comprise a flow interruption means. A flow interruption means, as used herein, is any means to temporarily interrupt the flow of the fabric treatment composition and hence allows the applicator to be in a "flow state" or in an "interruption state". Preferably such means is integral with the applicator, more preferably such means is comprised by the housing of the applicator and more preferably internal with the housing. In one preferred embodiment of the present invention the flow interruption means comprises a valve.

The flow interruption means is preferably easy to operate while holding and more preferably while using the applicator. Flow of fabric treatment composition may for example be allowed or interrupted by pressing a portion of the housing of the applicator. More preferably such flow interruption means is operated via the nib. "Operated via the nib", as used herein with regard to the flow interruption means, denotes a way of operation which allows for transition between the flow state and the interruption state of the applicator under the influence of the nib, preferably by exerting force onto the flow interruption means via the nib. Hence, in a preferred embodiment of the present invention the flow interruption means has an open position and a closed position and the position of the flow interruption means is changed between the open position and the closed position by a force applied to the nib.

In one preferred embodiment of the present invention a threshold pressure on the nib will allow the flow of the fabric treatment composition through the flow interruption means, while the flow is interrupted when exceeding the threshold pressure onto the nib is no longer exerted. Such valve embodiments are known e.g. for writing and highlighting pens as "press-and-release systems".

In one preferred embodiment of the present invention the applicator has a pen form and comprises a housing. The housing comprises an orifice, which is temporarily sealed by a base plate pressed against the orifice by means of a spring. The applicator in this preferred embodiment further comprises a nib which is mechanically attached to the base plate. Pressure onto the nib will temporarily remove the base plate from the sealing engagement with the orifice, so that fabric treatment composition flows past the base plate and through the orifice and can be applied via the nib.

In a further aspect the flow interruption means helps to prevent the evaporation of the fabric treatment composition. Evaporation is of particular concern for fabric treatment composition comprises heat activatable compounds, which easily evaporate when the applicator is e.g. stored in a pocket and thereby already during storage subjected to body heat.

The fluid interruption means allows a very controlled application of the fabric treatment composition. In absence of flow interruption means the need to rub over the whole area of a stain may result in the application of an unnecessary amount of fabric treatment composition, which namely for a bleach comprising fabric treatment composition may damage coloured and delicate fabrics. In a preferred embodiment of the present invention the use of a flow interruption means allows to release a certain amount of fabric treatment composition and to then use the nib to work this amount of fabric treatment composition into a fabric without thereby applying further fabric treatment composition. The threshold pressure is preferably to be selected to allow such operation.

In another embodiment of the present invention the threshold pressure is selected to allow fabric treatment composition flow whenever the nib is used—be it only to softly spread fabric treatment composition over the fabric—but to prevent evaporation when the fabric treatment applicator is not in use.

Preferred application devices according to the present invention also exhibit a certain delivery volume efficiency—measured as described below. If the applicator comprises a flow interruption means the delivery volume efficiency is to be measured when the flow interruption means is in the flow state. The delivery volume efficiency is defined as the amount of fluid (ml) delivered to the fabric per unit time per unit area ($s^{-1}$ $mm^{-2}$). The right delivery volume efficiency ensures that a sufficient but not too high amount of fabric treatment composition is delivered giving the benefits of a sufficient and constant flow rate and further the benefit of avoiding drying out of the nib or the reservoir in between uses. The delivery volume efficiency is preferably from 0.0005 ml $mm^{-2}$ $s^{-1}$ to 0.1 ml $mm^{-2}$ $s^{-1}$ and more preferably from 0.001 ml $mm^{-2}$ $S^{-1}$ to 0.01 ml $mm^{-2}$ $s^{-1}$.

The applicator may also comprise a cap to prevent evaporation of the composition and to prevent any unattended contact of the application device with objects when not used.

Methods of Application

Methods according to the present invention involve raising temperature of the fabric treatment composition. The composition has storage temperature before the fabric treatment applicator is used. Such storage temperature is typically the ambient temperature of the space where the composition is stored, e.g. the temperature inside a cupboard, a car, a handbag or a pocket, room temperature or outside temperature.

Raising of the temperature of the composition, as used herein, refers to a reference temperature T. The reference temperature T, as used herein, is the maximum temperature of the composition during application by the applicator or within the first 5 minutes after completion of the application by the applicator. The temperature of the composition is referred to as raised if the reference temperature T is higher than the storage temperature.

Methods according to the present invention afford a raise of the reference temperature T versus the storage temperature from 0.1° C. to 40° C., more preferably from 0.5° C. to 30° C., yet more preferably from 1° C. to 20° C., still more preferably from 2° C. to 10° C.

The compositions disclosed herein may find usage on any surface of a material in direct or indirect contact with the human body, which inter alia are all encompassed by the term fabric. These surfaces are typically soft surfaces comprised by materials such as soft plastic materials, leather and textile fabrics. Textile fabrics are found in garments, including shirts, ties, blouses, socks, skirts, trousers, jackets, underwear, watch straps, etc.

Moreover these compositions can be used on fabrics comprised by carpets, curtains or upholstery and the like.

One method according to the present invention is that the user pre-heats the applicator by holding it with one or two hands as to transfer body heat to the applicator and thereby the composition. Alternatively the user could bring the applicator in contact with any other part of the body in addition or instead of holding it with one or two hands, for example the arm pitch or crook. The pre-heating according to the present invention is done for a time span of 2 seconds to 2 hours, more preferably 3 seconds to 10 minutes, yet more preferably 5 seconds to 30 seconds. Such pre-heating will result in a temperature raise of the composition comprised by the applicator. This temperature raise will improve the performance of a heat activatable compound comprised by the composition, as demonstrated for a stain removal composition by the heat effect test described herein.

Other methods according to the present invention involve raising of the temperature of the composition during and/or after application. This can be achieved by applying the fabric treatment composition to fabrics which are in contact with the body of a person, either the user of the applicator or another person. For example, a fabric prior to heating, may be placed over the palm of a hand, an arm, a leg, etc., so as to transfer body heat to the fabric and thereby the fabric treatment composition during and/or after applying the composition.

A preferred method of application involves applying the fabric treatment composition to a fabric comprised by a garment which is worn. Wearing of a garment, as used herein, refers to wearing of a garment in the usual position on the body and can lead to indirect or direct contact of the fabric with the human body, to be understood as follows:

A garment like a shirt is often worn over an undergarment, while a jumper is often worn over an undergarment and over a shirt and while a coat is often worn over an undergarment, a shirt and a jumper or jacket. While the undergarment typically has direct contact, mostly skin contact, with the human body, those other garments have only indirect contact with the human body.

The temperature of any of these garments—may they have direct or indirect contact with the human body—will be raised with regard to ambient temperature, i.e. room temperature, due to the heat of the human body during wear (if the ambient temperature is below the human body temperature). Thereby the temperature of the composition will typically also be raised above storage temperature and hence, the compositions comprising heat activatable compounds can advantageously be used on any such garment, may it be in direct or in indirect contact with the human body.

Preferably the fabric treatment composition is applied to garments which are worn in their usual positions on the body and hence have direct or indirect body contact before, during and after the fabric treatment.

The exact use of any applicator with any composition disclosed herein will depend on the applicator itself and also on the fabric on which the applicator is to be used.

A towelette or wipe applicator is, if provided in a package, unpacked and used on selected areas of an fabric by wiping or rubbing the areas by a user using the hands.

For a fabric treatment applicator comprising a housing and an application device, the cap covering the application device, if present, is removed before application. The application device is then brought into contact with a selected area of an fabric. For some application devices exertion of pressure may be needed to release the composition from the applicator. The pressure initially needed for this purpose may be higher than the pressure needed to ensure constant the flow of the composition. Wiping or otherwise moving the application device over the selected application area may also be required to deliver the composition to all parts of this area and may help to uniformly apply the composition. Rubbing, i.e. wiping while exerting pressure towards the fabric, may help in the mechanical removal of stains.

The application of any composition disclosed herein, may be one step of a more comprehensive treatment of a fabric. For example, the application of a stain removal composition may be followed by the application of a pre-laundry composition, by laundering or may be followed by a rinsing or drying step. A rinsing step may be carried out with a dedicated rinsing composition such as alcohol, glycol or pure water. However, due to the water content of the composition of the present invention such an additional rinsing step is normally not needed. A drying step may be a treatment with a dry or slightly moist wipe or an absorbent pad. However, a drying step is normally not needed, since the compositions disclosed herein promote quick drying and the applicators disclosed herein allow application to small areas.

Test Methods

Dye Removal Test

An expert panel assists in visual grading. Thus, in one such test, swatches of fabric are individually dyed with a dye from a representative dye category such as from reactive dyes, sulphur dyes, vat dyes, direct dyes and azoic dyes. A swatch of fabric is prepared with a dye from each category. A measured area within each swatch is treated with the fabric treatment composition and allowed to dry. Any dye removal in the treated swatch is assessed visually by comparing the treated area of the swatch with the surrounding untreated area of the swatch. Numerical units ranging from: (0) 'no difference between both fabrics', (1) 'I think there is a difference', (2) 'I'm sure there is a difference', (3) 'there is a big difference', (4) 'there is a huge difference' are assigned by panelists. The test is repeated three times of any swatch and an average value is calculated.

Heat Effect Test

The following testing procedure can be used to assess the effect of heat on a consumer noticeable benefit when a composition is applied to a fabric.

Nine swatches of white cotton (number 1660, Habeco) are individually treated with one drop of a filter coffee solution (normal strength) from a 1 ml pipette (Elkay 127-P1511-000) held at a distance of 10 cm from the fabric surface. The desired temperature is achieved by heating the stain removal composition on a heating plate until it reaches the target temperature (10° C. reference solution, 30° C. or 50° C.) as measured by a temperature probe. When the desired temperature is achieved, a pipette (described above) is used to apply one drop of the heated stain removal solution as specified below to a stained swatch. The stain removal solution is then massaged into the coffee stain with a stain removal pen (described above) for 10 seconds. This is repeated until three swatches have been treated with the solution. The swatches are then allowed to dry for 24 hours at room temperature in a sealed cupboard. This is performed with solutions at all three temperatures. The level of stain removal for each temperature is then visually assessed by comparing it to the level of removal for the 10° C. reference solution. Numerical units ranging from: (0) 'no difference between both swatches', (1) 'I think there is a difference', (2) 'I'm sure there is a difference', (3) 'there is a big difference', (4) 'there is a huge difference' are assigned by expert panelists. A "+" sign indicates improved performance versus the reference solution. The test is repeated three times for any selected temperature and an average value is calculated.

Stain removal solution used in heat effect test:

| | % (wt) of 100% active component formula range |
|---|---|
| BPP | 2.0 |
| Hydrogen peroxide | 2.0 |
| Alkyl sulfate surfactant | 0.8 |

-continued

| | % (wt) of 100% active component formula range |
|---|---|
| Perfume | 0.01 |
| Ethanol | 0.7510 |
| EDTA | 0.005 |
| Water | 94.1368 |

Results

| Swatch | Numerical unit 10° C. solution (reference) | 30° C. solution | 50° C. solution |
|---|---|---|---|
| replicate 1 | 0 | +2 | +3.5 |
| replicate 2 | 0 | +2.75 | +4 |
| replicate 3 | 0 | +2.5 | +3.25 |
| average | 0 | +2.4 | +3.6 |

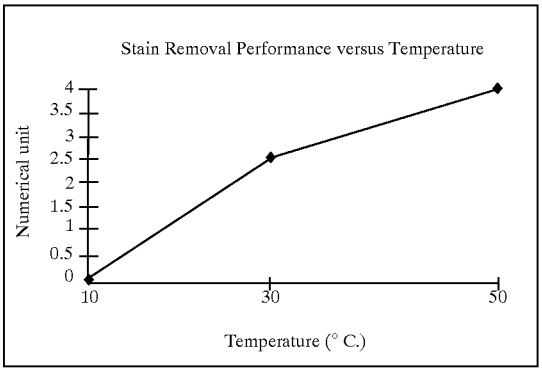

Measurement of Contact Area

Measurements of the contact area of the nib are carried out with a fabric treatment applicator which contains a dry nib and no treatment composition. The dry nib is inked by pressing it against an ink stamp pad and then clamping the fabric treatment applicator to the load arm of a Plint dual axis reciprocating rig (such as model TE75R, MRPRA RUBBER CONSULTANTS). A mark on a contact surface which is representative of the contact area of the nib is obtained by controlled lowering and raising of the Plint load arm towards and away from the contact surface. The angle of the fabric treatment applicator relative to the contact surface is adapted to maximise the contact area. Angles of the fabric treatment applicator relative to the contact surface for which the angle between the vertical axis of the fabric treatment applicator (as defined above) and the contact surface less than 45° are not considered (since they are not typical for a consumer preferred application method). The contact time should be approximately 1s while a 3N load is applied on the nib. The contact area can then be calculated from the mean length and width of the mark determined using a magnifying lens with a graticule. Average measurements with the nib in final measuring position are repeated three times to check reproducibility.

Measurement of Delivery Volume Efficiency

The application device, e.g. nib, is firmly inserted through the bottom of a standard liquid container (such as a 50 ml centrifuge tube available from Corning No. 25330-50). To ensure a secure arrangement, the size of the orifice through which the application device is inserted is cut to the size of the tip and a silicone based sealant used. This unit is then clamped into position beneath a compressor unit (such as a Lloyd LR5K Compression meter). This arrangement provides a consumer realistic vertical load of 3N. The application device is placed in contact with an absorbent pad comprised of a bicomponent synthetic fibre top layer above a fluffy pulp base layer. The pad allows rapid transport away from the point of delivery so as not to reduce the concentration gradient and hence reduce flow. The container is then filled with the stain removing solution (such as Example 1) to a level of 20 ml. The amount of fluid that flows per unit time is measured by noting the loss of fluid from the reservoir over a fixed period. The delivery volume efficiency (DVE) is calculated by normalising the flow rate with respect to the total surface area of contact ($mm^2$) between the application device and the fabric. Measurements are repeated three times to check reproducibility.

What is claimed is:

1. A method for treating a fabric, said method comprising the application of a fabric treatment composition to a portion of said fabric, said fabric treatment composition comprising at least one heat activatable compound, wherein the temperature of said composition is raised by the body heat of a person, said composition being applied from an applicator, said applicator comprising a fiber-tip nib, wherein said applicator further comprises a flow interruption means having an open position and a closed position, wherein the position of said flow interruption means is changed between the open position and the closed position by force applied to said nib.

2. A method for treating a fabric according to claim 1 wherein said fabric is pre-heated by a user's hands.

3. A method for treating a fabric according to claim 1 wherein said fabric is comprised by a garment which is not worn by said person.

4. A method for treating a fabric according to claim 1 wherein said fabric is comprised by a garment which is worn by said person.

5. A method for treating a fabric according to claim 4 wherein said garment is in direct contact with the skin of said person.

6. A method for treating a fabric according to claim 4 wherein said garment is in indirect contact with the skin of said person.

7. A method for treating a fabric according to claim 1, wherein said heat activatable compound is a peroxide bleach.

8. A method for treating a fabric according to claim 1, wherein said heat activatable compound is an enzyme.

* * * * *